US007926690B1

(12) United States Patent
Tippmann, Sr.

(10) Patent No.: US 7,926,690 B1
(45) Date of Patent: Apr. 19, 2011

(54) COMBUSTION POWERED DRIVER

(76) Inventor: Dennis J. Tippmann, Sr., New Haven, IN (US)

( * ) Notice: Subject to any disclaimer, the term of this patent is extended or adjusted under 35 U.S.C. 154(b) by 131 days.

(21) Appl. No.: 12/139,045

(22) Filed: Jun. 13, 2008

Related U.S. Application Data

(60) Provisional application No. 60/943,789, filed on Jun. 13, 2007, provisional application No. 60/943,887, filed on Jun. 14, 2007.

(51) Int. Cl.
*B25D 9/00* (2006.01)

(52) U.S. Cl. ..... 227/10; 227/8; 173/207; 173/208; 173/209; 173/210; 173/135; 173/137; 173/138; 173/90; 173/200; 123/46 SC

(58) Field of Classification Search ..... 173/207–210, 173/135, 137–138, 90, 200, 13; 227/8–10; 123/46 SC See application file for complete search history.

(56) References Cited

U.S. PATENT DOCUMENTS

| | | | | | |
|---|---|---|---|---|---|
| 1,424,188 | A | * | 8/1922 | Smith | 173/80 |
| 2,167,983 | A | * | 8/1939 | Kiecksee | 173/125 |
| 2,305,772 | A | * | 12/1942 | Haage | 123/46 R |
| 2,723,532 | A | * | 11/1955 | Smith | 173/131 |
| 2,748,751 | A | * | 6/1956 | Johnson | 91/224 |
| 2,755,783 | A | | 7/1956 | Kupka | |
| 2,948,122 | A | * | 8/1960 | Smith | 173/131 |
| 3,012,549 | A | * | 12/1961 | Bard et al. | 173/209 |
| 3,049,109 | A | | 8/1962 | Schley | |
| 3,229,589 | A | * | 1/1966 | Langas | 91/416 |
| 3,250,334 | A | * | 5/1966 | Sussman | 173/18 |
| 3,679,005 | A | | 7/1972 | Inaba et al. | |
| 3,838,741 | A | * | 10/1974 | Pepe | 173/115 |
| 3,872,934 | A | * | 3/1975 | Terada | 173/207 |
| 3,967,688 | A | | 7/1976 | Inenaga et al. | |
| 3,991,833 | A | * | 11/1976 | Ruppert | 173/20 |
| 4,034,816 | A | | 7/1977 | Lutich et al. | |
| 4,075,850 | A | | 2/1978 | Nakazato et al. | |
| 4,109,475 | A | | 8/1978 | Schnell | |
| 4,127,057 | A | * | 11/1978 | Stubenruss | 91/52 |
| 4,408,668 | A | * | 10/1983 | Kuhn et al. | 173/212 |
| 4,513,828 | A | * | 4/1985 | Chappelow et al. | 173/210 |
| 4,548,278 | A | | 10/1985 | Gidlund | |
| 4,750,568 | A | | 6/1988 | Roxton et al. | |
| 4,877,046 | A | * | 10/1989 | Albrigtsen et al. | 137/107 |
| 4,903,784 | A | | 2/1990 | Glaser | |
| 5,097,913 | A | | 3/1992 | Lennart Gustafsson | |
| 5,540,136 | A | * | 7/1996 | Noord | 91/224 |
| 5,695,197 | A | * | 12/1997 | Farley et al. | 277/311 |
| 6,209,659 | B1 | * | 4/2001 | Blessing | 173/201 |
| 6,318,228 | B1 | | 11/2001 | Thompson | |
| 6,564,688 | B2 | | 5/2003 | Sabates et al. | |
| 6,776,242 | B1 | * | 8/2004 | Cunningham | 173/90 |

* cited by examiner

*Primary Examiner* — Rinaldi I. Rada
*Assistant Examiner* — Michelle Lopez
(74) *Attorney, Agent, or Firm* — Barnes & Thornburg LLP

(57) ABSTRACT

A device for driving various objects using combustible fuel. Embodiments are contemplated in which the driver could be a post-driver, a power shovel, a jack-hammer or other devices. Typically, the device includes a body with a combustion chamber. A fuel injection valve selectively supplies fuel to the combustion chamber where it can be ignited using an ignition module. A piston is movable within the body to impact the ram responsive to combustion in the combustion chamber.

41 Claims, 13 Drawing Sheets

COMBUSTION POWERED DRIVER

RELATED APPLICATIONS

The present application is related to and claims priority to U.S. Provisional Patent Application Ser. No. 60/943,789, filed on Jun. 13, 2007, entitled Combustion Powered Driver and U.S. Provisional Patent Application Ser. No. 60/943,887 filed on Jun. 14, 2007, entitled Combustion Powered Driver. The entire subject matter disclosed in those provisional applications is hereby expressly incorporated by reference into the present application.

TECHNICAL FIELD

This invention relates generally to an apparatus for driving an object, including but not limited to a post driver, power shovel, log splitter, and concrete breaker. In some embodiments, the apparatus uses energy from the combustion of combustible fuel to drive the object.

BACKGROUND

Posts have many different purposes, such as for signs, fences, etc. In some cases, a post may be installed by driving it into the ground. Although posts were originally manually driven into the ground, such as with a sledgehammer, mechanical post drivers are also known. Mechanical post drivers often include a heavy hammer that is raised and then dropped onto the post. Some post drivers include hydraulic pressure or a cable assembly to raise and drop the hammer. Although such post drivers perform the intended function, the heavy hammer reduces portability and requires a massive support structure. Therefore, there is a need for an improved driver.

SUMMARY

According to one aspect, the present invention provides an apparatus for driving a post. The apparatus may have a driver body with a combustion chamber. A fuel injection valve may be provided that selectively controls the flow of fuel into the combustion chamber. The apparatus may include an ignition module adapted to ignite fuel within the combustion chamber. In some preferred embodiments, for example, the apparatus could use a readily available propane cylinder. A ram and piston may be provided that are movable within the driver body. The piston may be adapted to impact the ram in response to combustion within the combustion chamber. In some embodiments, the ram may include a resilient portion that flexes when the piston impacts the ram. Embodiments are also contemplated with a valve that selectively opens/closes a passageway through the piston. According to a further embodiment, one or more handles may extend from the driver body. In some cases, the handles may include grip portions that are movable with respect to the handle. In some preferred embodiments, for example, the apparatus is self-contained and portable, which allows an easier and more efficient manner of driving a post.

According to another aspect, the invention provides a free piston internal combustion engine. The engine would include a cylinder having a first end with a first projection and a second end with a second projection. A combustion chamber is disposed within the cylinder. An ignition module is provided for igniting fuel within the combustion chamber. The engine includes a piston movable within the cylinder between the first end and the second end. The piston moves toward the second end responsive to combustion in the combustion chamber. A passageway is defined through the piston. A biasing member is provided to urge the piston toward the first end of the cylinder. The engine includes a piston valve movable between an open position and a closed position, in which the piston valve prevents fluid flow though the passageway in the closed position, but allows fluid flow through the passageway in the open position. Typically, at least a portion of the piston valve is disposed within the piston. The piston valve moves to the closed position when a first end of the piston valve contacts the first projection, but moves to the open position when a second end of the piston valve contacts the second projection.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplification set out herein illustrates example embodiments of the invention, and such exemplification is not to be construed as limiting the scope of the invention in any manner.

DETAILED DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary constructions.

Figure 1:
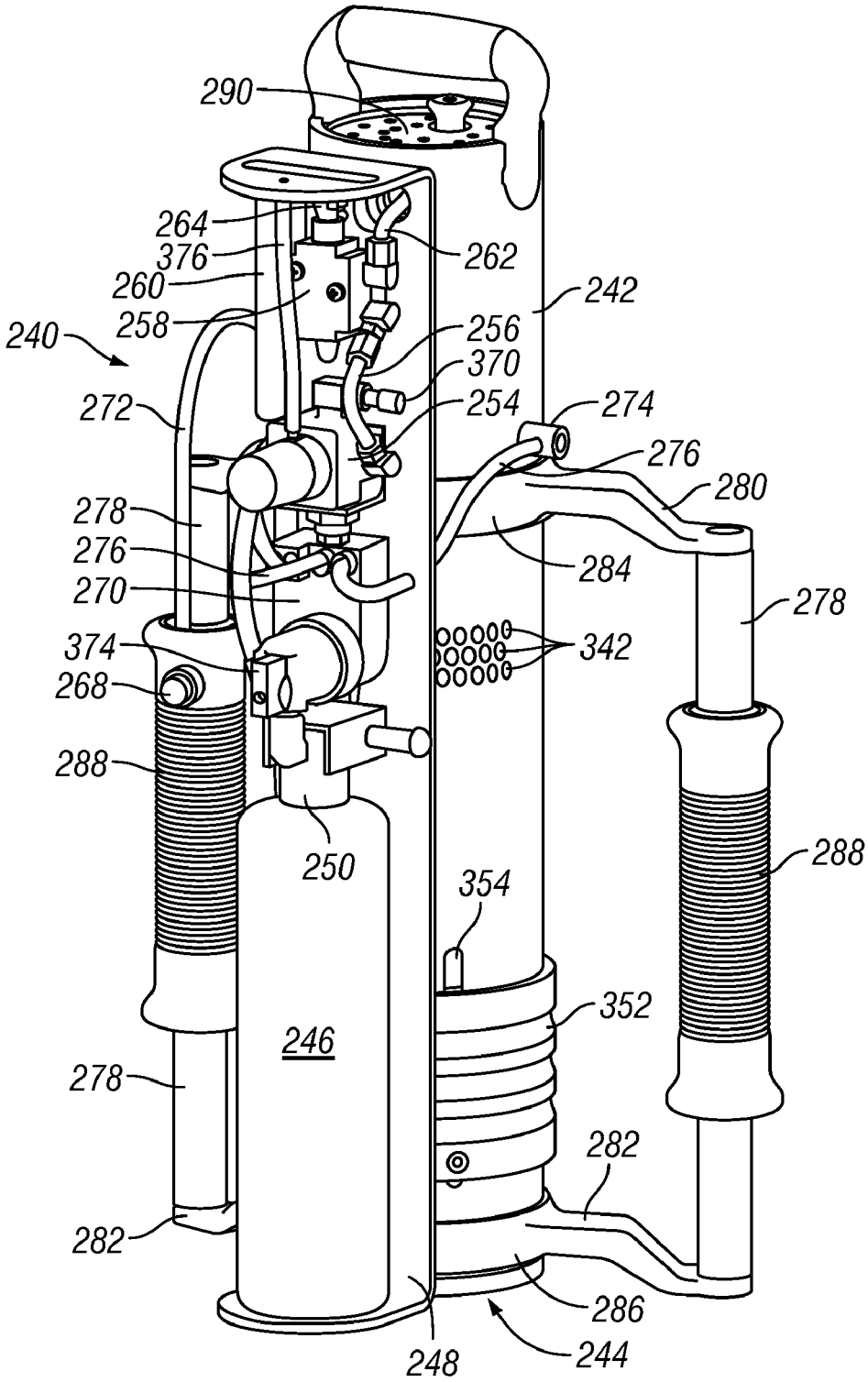
FIG. 1 is a perspective view of a post driver according to an embodiment of the invention.

FIG. 1 shows a post driving apparatus, generally referred to by reference number 240. In the example shown, the post driving apparatus 240 has a driver body 242. Although the driver body 242 is cylindrical in the example shown, the body could have a square, oval, or other cross-sectional shape. The driver body 242 may be formed from steel, aluminum, fiberglass, or any other suitable rigid material. The lower end 244 of the driver body 242 is adapted to receive a post to be driven, as described below. The apparatus 240 may drive wooden posts, metal posts, fiberglass posts, or other types of posts. The apparatus 240 may drive round posts, square posts, U-channel posts, or other post shapes. Embodiments are also contemplated in which the apparatus could be adapted for driving a power shovel. By way of another example, embodiments are contemplated in which the apparatus could be adapted to split logs or break concrete. One skilled in the art should appreciate that the system could be adapted to reciprocately drive any object.

The apparatus 240 drives a post using energy generated by the combustion of fuel. The term "fuel" is broadly intended to encompass any ignitable fluid, such as liquefied petroleum ("LP") gas, natural gas, or gasoline. For purposes of example only, the fuel may include propane, butane, isobutene, methylacetylene-propadiene ("MAPP"), or acetylene. A fuel reservoir 246 is adapted to hold a quantity of fuel. In the embodiment shown, the fuel reservoir 246 is carried by a mounting shelf 248, which is coupled to the driver body 242. A cover (FIG. 16) may be provided over the mounting shelf for safety purposes. In some cases, the fuel reservoir 246 could be refillable; alternatively, the fuel reservoir 246 may be disposable. For example, the fuel reservoir 246 could be a readily available propane cylinder.

In the example shown, the top end of the fuel reservoir 246 defines a fuel outlet port 250 through which fuel may exit the fuel reservoir 246. In some cases, such as when liquefied petroleum gas is used, the fuel exits through the fuel outlet port 250 due to pressure within the fuel reservoir 246. It should be appreciated, however, that a fuel pump (not shown) could be provided at the fuel outlet port 250 to supply pressurized fuel if the fuel reservoir 246 is not pressurized. Embodiments are contemplated in which an evaporator system could be used to change any liquid fuel supplied by the fuel reservoir 246 to a gaseous state prior to entering an optional fuel regulator 254. By way of example only, the fuel regulator 254 limits the pressure of fuel exiting the fuel reservoir 246 to approximately 40 to 120 pounds per square inch (psi). Instead of a fuel regulator, embodiments are contemplated using a metered chamber.

A conduit 256 supplies fuel from the fuel regulator 254 to a fuel injection valve 258. The fuel injection valve 258 is in fluid communication with a calibrated fuel reservoir 260 and fuel inlet conduit 262. The calibrated fuel reservoir 260 contains a predetermined volume, which allows a predetermined amount of fuel to be supplied. In this embodiment, the fuel injection valve 258 prevents fluid communication between the conduit 256 and the calibrated fuel reservoir 260 when the valve stem 264 is not actuated (i.e., not depressed in this example). Accordingly, in this example, the fuel injection valve 258 prevents fuel from entering the calibrated fuel reservoir 260 when the valve stem 264 is not depressed. Conversely, the fuel injection valve 258 allows fuel to flow into the calibrated fuel reservoir 260 when the valve stem 264 is depressed; however, the fuel injection valve 258 prevents fluid flow between the calibrated fuel reservoir 260 and the fuel inlet conduit 262 when depressed. Accordingly, depressing the fuel injection valve's 258 valve stem 264 fills the calibrated fuel reservoir 260 with fuel, but prevents flow from the calibrated fuel reservoir 260 to the fuel inlet conduit 262. When the valve stem 264 is released, the fuel injection valve 258 allows flow from the calibrated fuel reservoir 260 into the fuel inlet conduit 262. As described below, the fuel inlet conduit 262 provides fuel to a combustion chamber 266 (e.g., FIG. 3) within the driver body 242. The use of the calibrated fuel reservoir 260 regulates the amount of fuel provided to the combustion chamber 266. The fuel injection valve 258 prevents flow from the conduit 256 into the calibrated fuel reservoir 260 when the valve stem 264 is released. It should be appreciated that other mechanisms could be used to provide a regulated amount of fuel to the combustion chamber 266.

The apparatus 240 includes an actuator 268 adapted to actuate driving of a post. In the example shown, the actuator 268 is electrically coupled to an ignition module 270 using a wire 272. The ignition module 270 is adapted to produce a spark within the combustion chamber 266 responsive to the actuator 268. For example, the ignition module 270 may be electrically coupled to one or more spark plugs 274 for generating a spark within the combustion chamber 266. In this example, the ignition module 270 is electrically coupled to the spark plugs 274 using wires 276.

In the example shown, the actuator 268 is a push-button switch. Typically, the ignition module 270 substantially continuously generates sparks when the user pushes the actuator 268. It should be appreciated that other mechanisms, including but not limited to a toggle switch and proximity switch, could selectively actuate the ignition module 270. It should be appreciated by one skilled in the art that a number of mechanisms could be used to control the timing of combustion, such as a timing circuit, Hall-effect sensor(s), optical sensor(s), etc.

The apparatus 240 may include handles 278 for a user to hold when driving a post. In the example shown, the handles 278 include upper supports 280 and lower supports 282 coupled to the driver body 242. The supports 280, 282 could be coupled to the driver body 242 using a frictional fit, interference fit, welding, adhesive or other coupling mechanism. As shown, the driver body 242 includes an upper ring 284 and a lower ring 286 that are coupled to the supports 280, 282.

In the example shown, the apparatus 240 includes grip portions 288, which the user would hold during use, that are movable with respect to the handles 278. In this arrangement, the user's hands remain relatively stationary while the handles 278 move in a reciprocating motion during use. The ability to maintain a relatively stationary position of the user's hands during use insulates the user from the shock of the apparatus 240 and allows for more prolonged use. In the example shown, the actuator 268 is disposed on a grip portion 288, which allows the actuator 268 to maintain a relatively stationary position during use.

Figure 16:
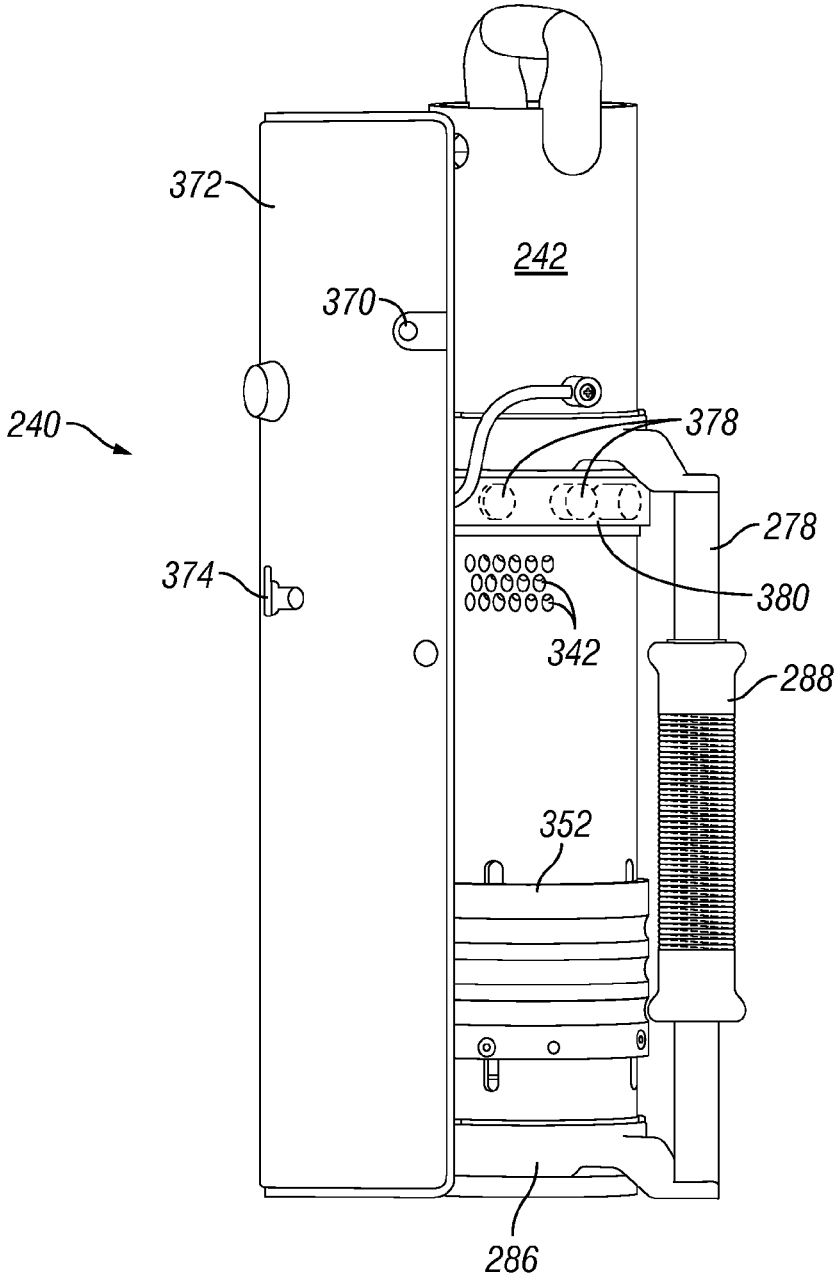
FIG. 16 is a side view of the post driver shown in FIG. 1.

In the example shown, a valve 370, such as a Schrader valve, is provided to allow an external gauge to determine the fuel pressure. For example, a user could insert a pressure gauge into the valve 370 to check the pressure, similar to checking the air pressure of a tire. Embodiments are contemplated in which an on-board pressure readout or gauge could be provided. As best seen in FIG. 16, an opening is provided in a cover 372 to allow access to the valve 370. As shown, this embodiment includes an on/off valve 374 for opening/closing the supply of fuel to the apparatus 240. An opening is provided in the cover 372 to allow access to the on/off valve 374. In some embodiments, a vent 376 may be provided to vent fuel if the fuel pressure exceeds a predetermined threshold pressure. As shown, the vent 376 extends upward to the top end of the apparatus 240 so that vented fuel is expelled above the user.

Figure 2:
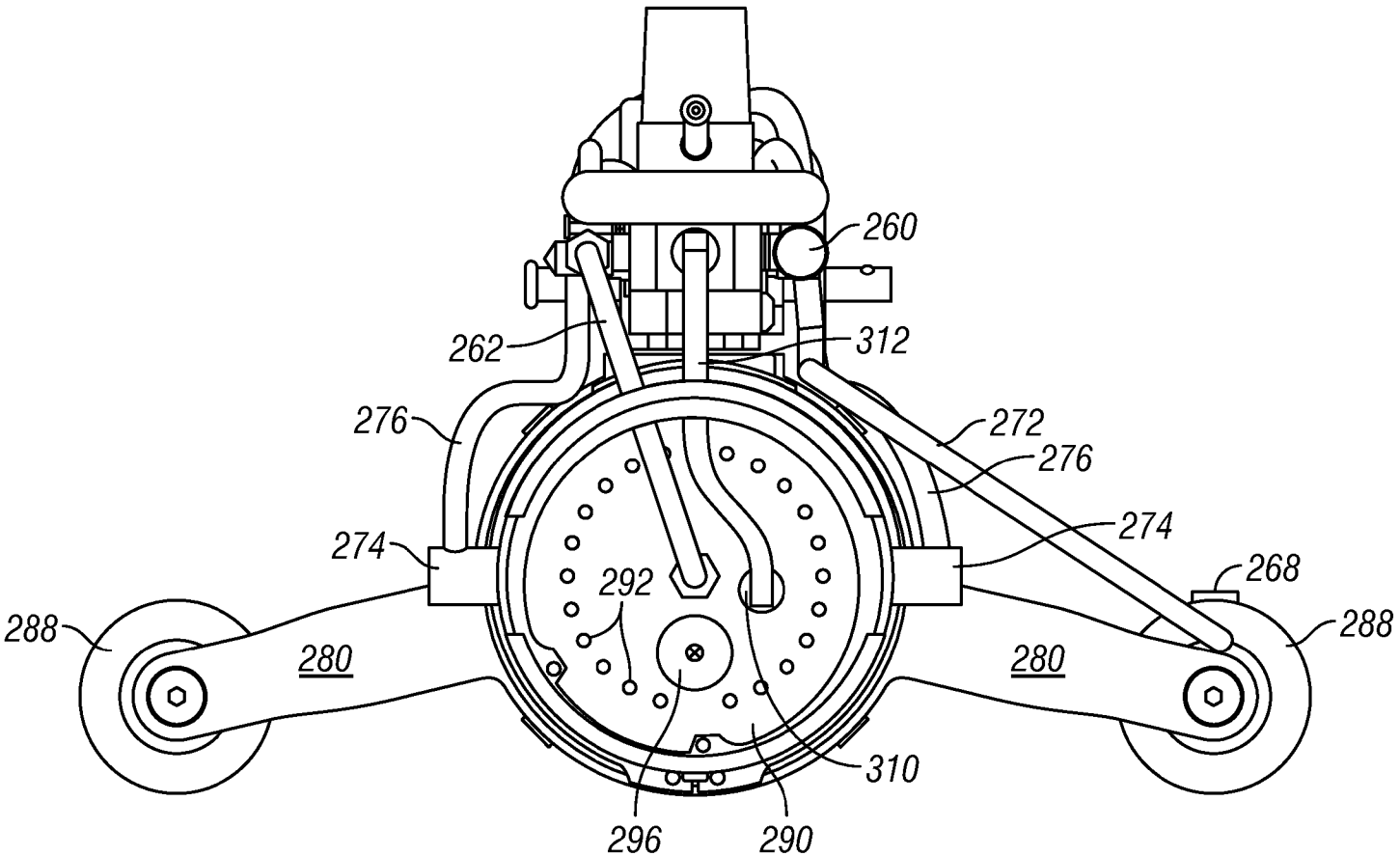
FIG. 2 is a top cross-sectional view of the post driver shown in FIG. 1.

FIG. 2 shows a top view of the apparatus 240. In this view, a cylinder head 290 disposed in an upper portion of the drive body 242 is visible. The cylinder head 290 defines air intake ports 292 through which air may be drawn into the combustion chamber 266. A priming valve actuator 296 for opening a priming valve 298 is provided (FIGS. 4-5), thereby allowing fluid communication between the combustion chamber 266 and the ambient atmosphere to allow manual priming of the apparatus 240, as discussed below.

Figure 3:
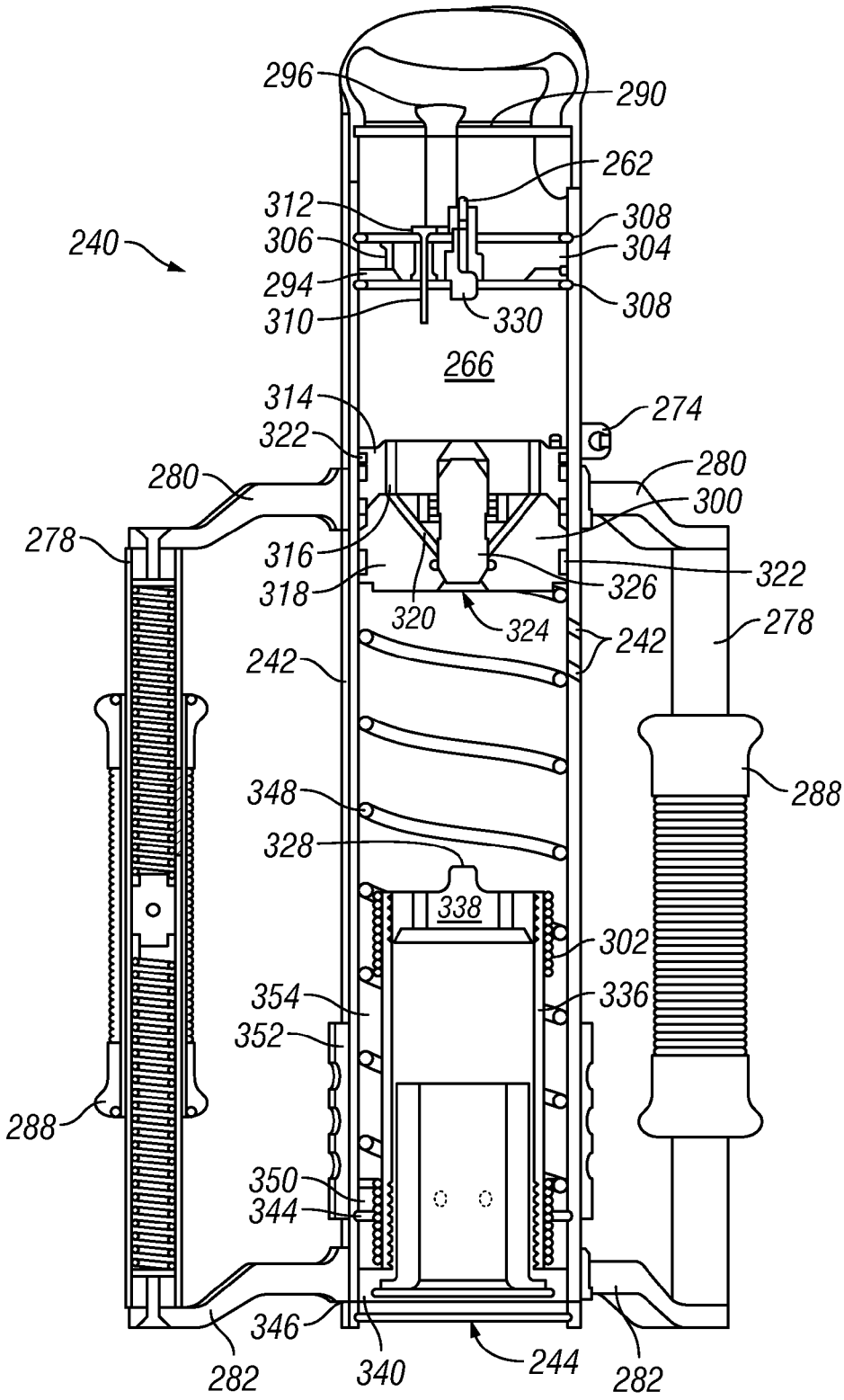
FIG. 3 is a side cross-sectional view of the post driver shown in FIG. 1 with the piston in an initial position.

Referring now to FIG. 3, the driver body 242 defines a cavity dimensioned to receive internal components of the apparatus 240, which generate energy from the combustion of fuel to drive a post (or other object). For example, combustion pressure may be generated within the combustion chamber 266, which propels a piston 300 into a ram 302 to provide a driving force to a post.

In the example shown, a wall 304 defines air intake ports 306 for drawing air into the combustion chamber 266. A one-way valve 294, such as a Reed valve, prevents combustion gases from escaping the combustion chamber 266 through the air intake ports 306. In some cases, a portion of the Reed valve may be exposed to combustion; in such cases, the Reed valve may include a material such as silicon or viton, which can withstand the high temperatures associated with combustion. The bottom portion of the wall 304 defines an upper wall of the combustion chamber 266. The wall 304 is preferably fixed within the driver body 242 using snap rings 308. It should be appreciated, however, that the wall 304 could be fixed by welding, adhesive, or other suitable fasteners.

Figure 4:
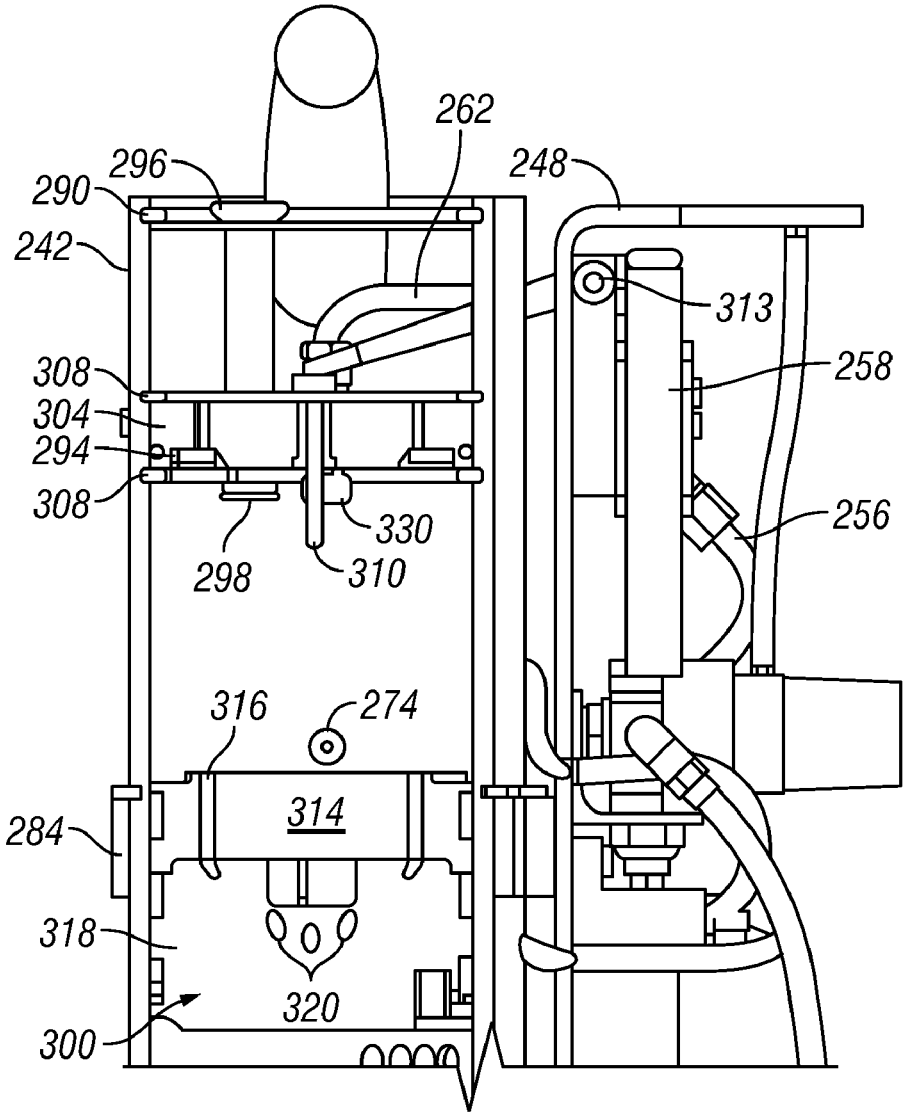
FIG. 4 is a detailed side cross-sectional view of the upper portion of the post driver showing the primer valve in an open position.
Figure 5:
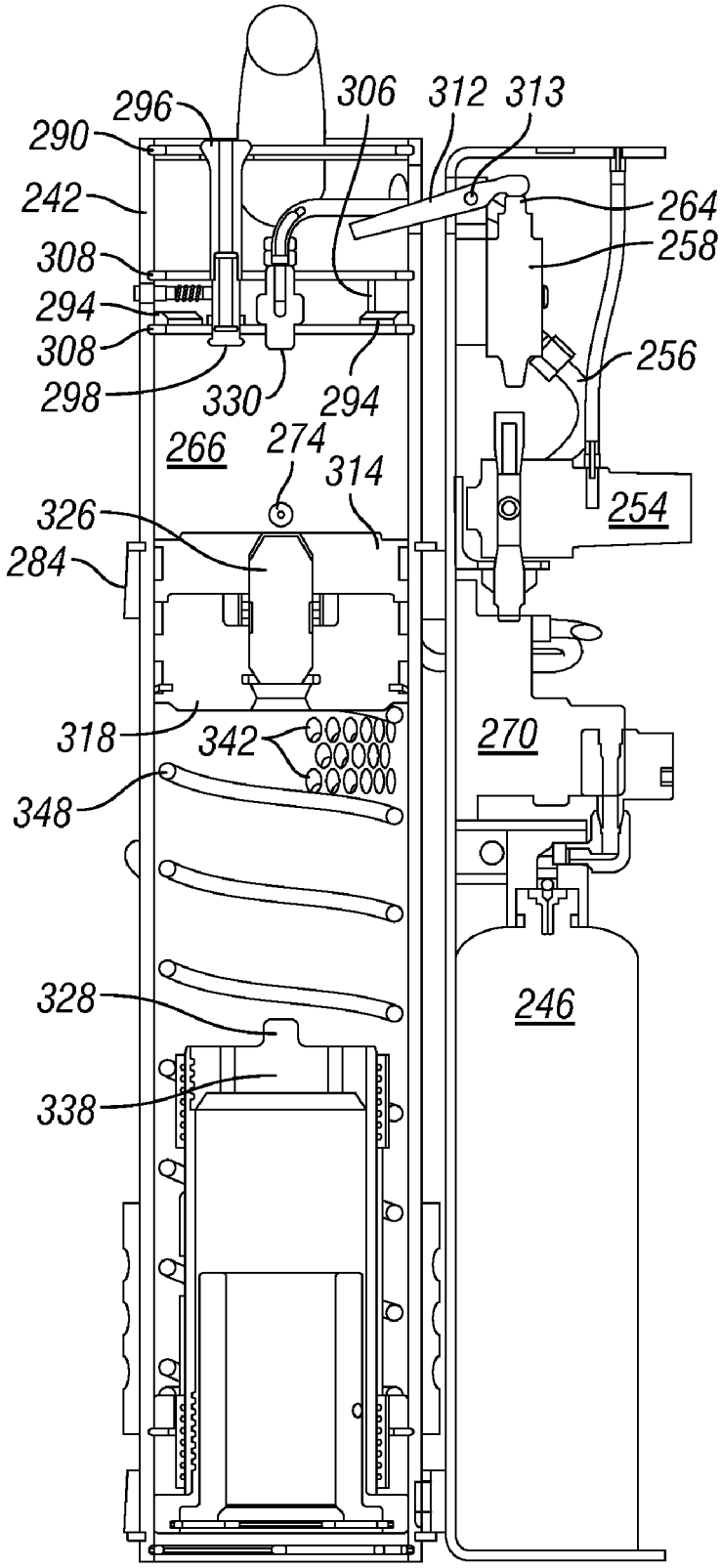
FIG. 5 is a side cross-sectional view of the upper portion of the post driver showing the primer valve in an open position.
Figure 6:
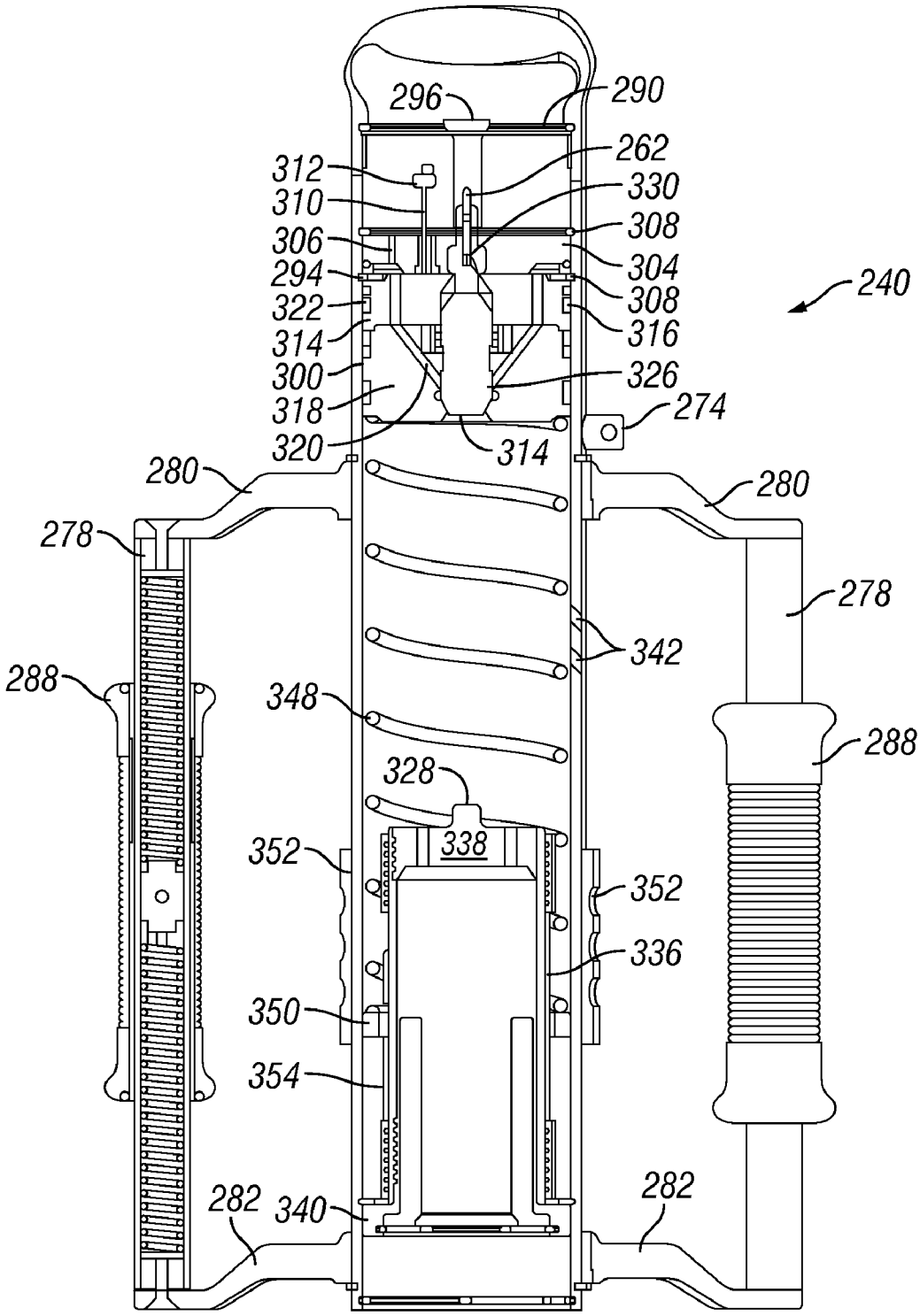
FIG. 6 is a side cross-sectional view of the post driver shown in FIG. 1 piston in a priming position.

A pin 310 is disposed in the wall 304. The pin 310 is movable between a lowered position (as shown in FIG. 3) and a raised position (FIG. 6). The movement of the pin 310 to the raised position due to the position of the piston 300 rotates a lever 312 about a pivot point 313, which actuates the valve stem 264 of the fuel injection valve 258 as best seen in FIGS. 4-5.

The ignition of a fuel/air mixture with the combustion chamber 266 propels the piston 300 downward into the ram 302. In the embodiment shown, the piston 300 includes an upper member 314 with upper ports 316 and a lower member 318 with lower ports 320. As shown, the lower member 318 includes a shoulder 392 that is received by a recess 394 in the upper member 314 (best seen in FIG. 11). In the embodiment shown the lower member 318 is tapered to receive the biasing member 348. In this example, the upper member 314 and lower member 318 include grooves for one or more seals 322, which prevents flow around the piston 300. In some cases, the seals 322 may be formed from carbon fiber PTFE and/or PTFE filled bronze, which eliminates the need for lubrication, such as oil, on the interior surface of the driver body 242. In one embodiment, the uppermost seal, which is closest to the combustion chamber 266, is formed from a heat resistant material, such as carbon fiber PTFE, to shield the lower seals from the heat radiating from the combustion chamber 266. In such an embodiment, the lower seals could be formed from PTFE filled bronze, which has a higher wear resistance to increase the life of the uppermost seal.

Figure 7:
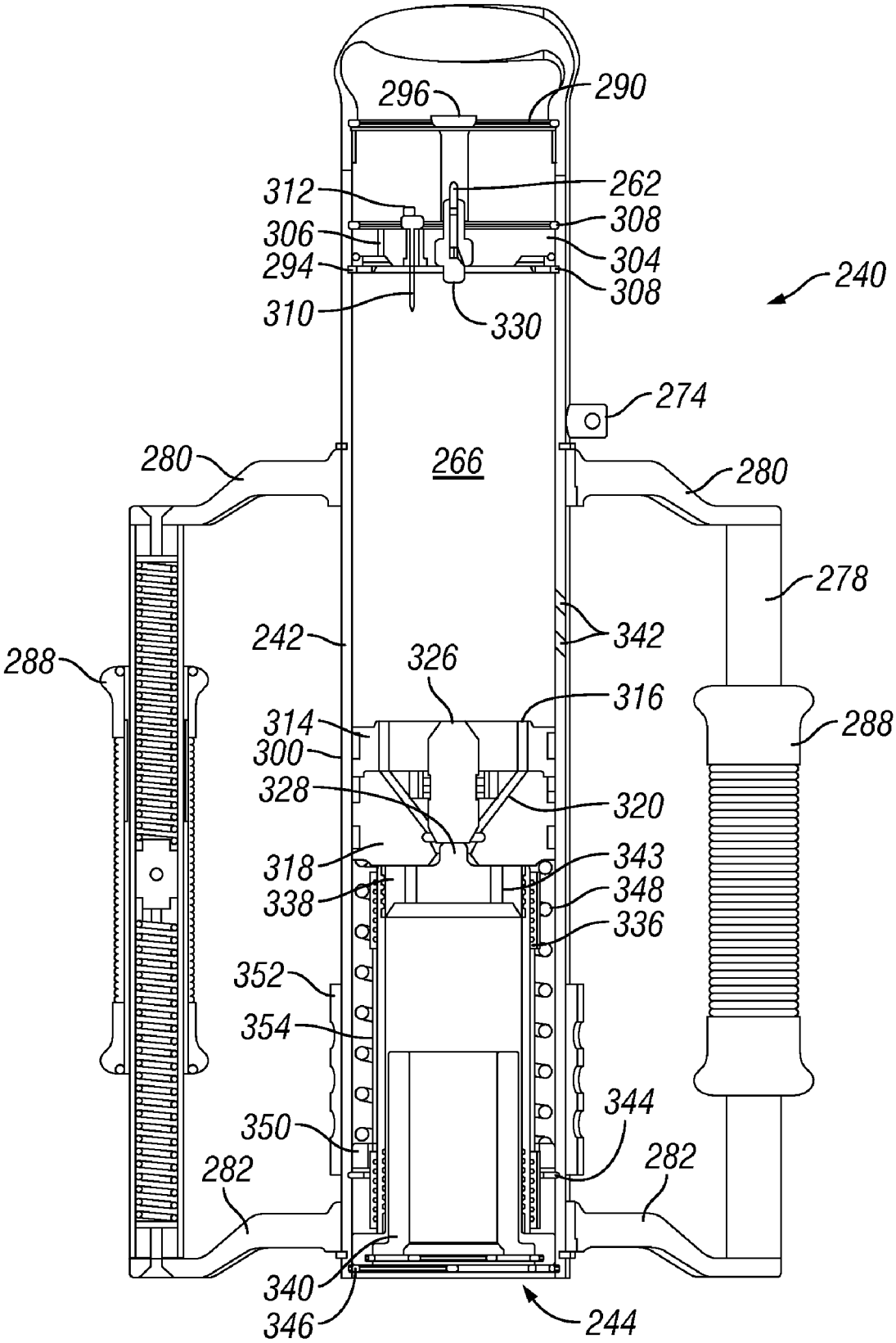
FIG. 7 is a side cross-sectional view of the post driver shown in FIG. 1 with the piston impacting the ram.

In the example shown, the piston 300 includes a cavity 324 dimensioned to receive a valve 326. The valve 326 is movable between a closed position (FIGS. 3, 6, and 8) that prevents fluid communication between the upper ports 316 and the lower ports 320 of the piston 300 and an open position (FIG. 7) that allows fluid communication. As discussed below, the valve 326 moves to the open position when the lower end of the valve 326 contacts a tip 328 on the ram 302 (FIG. 7). When the upper portion of the valve 326 contacts an injector 330 (or other projection) extending from the wall 304 (FIG. 8), the valve 300 moves to the closed position.

Figure 11:
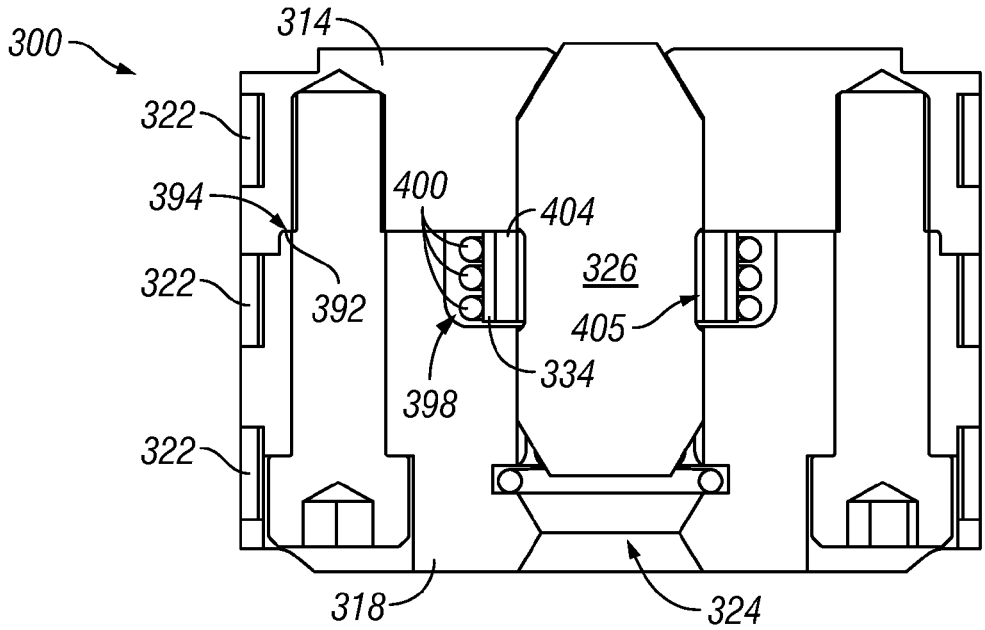
FIG. 11 is a side cross-sectional view of the piston shown in FIG. 3.
Figure 12:
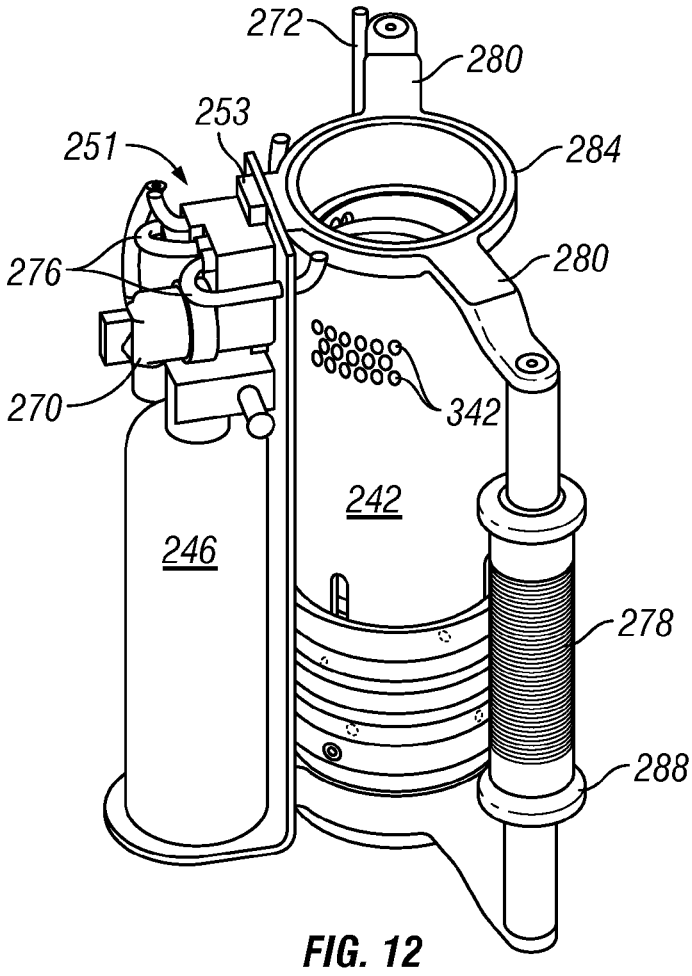
FIG. 12 is a detailed cross-sectional view of the post driver shown in FIG. 1.

In the embodiment shown, the piston 300 defines a recess 398 in which o-rings 400, a retaining member 334 and a braking member 404 are disposed, as best seen in FIG. 11. The o-rings 400 use resiliency to urge the braking member 404 against the surface of the valve 326. As shown, the valve includes a circumferential groove 405 which maintains an open position of the valve 326 against the force of inertia due to the friction of the braking member 404 against the valve 326. In some cases, the braking member 404 may be formed of carbon fiber PTFE or PTFE filled bronze.

In the example embodiment shown, the ram 302 is disposed within the driver body 242 below the piston 300. As shown, the ram 302 includes a resilient member 336 with a top end coupled to a piston impact portion 338 and a lower end coupled to a post receiving member 340. The resilient member 336 allows the piston impact portion 338 to be suspended above the post receiving member 340.

The top end of the piston impact portion 338 impedes downward movement of the piston 300 when the piston 300 is propelled downward from ignition in the combustion chamber 266. Preferably, a post (or other object to be driven) is adjacent the lower end of the piston impact portion 338. Accordingly, the force of the piston 300 impacting the ram 302 is transmitted to the post by the lower end of the piston impact portion 338. The resilient member 336 withstands the force transmitted by the piston impact portion 338, which increases the life of the ram 302.

In the embodiment shown, the contact between the lower end of the valve 326 with the tip 328 defined on the upper end of the piston impact portion 338 moves the valve 326 to the open position, thereby allowing exhaust gas to flow through ports 316, 320 in the piston 300. The exhaust gas may also be vented through exhaust ports 342, 343 defined in the driver body 242 and piston impact portion 338 (FIG. 7). In the example shown, the piston impact portion 338 has an approximately circular cross-section, but could have other shapes. The piston impact portion 338 is preferably metal, including but not limited to carbon steel, stainless steel and aluminum.

The upper portion of the resilient member 336 may be coupled to the piston impact portion 338 with fasteners such as bolts, screws, rivets, adhesive, or other suitable fasteners. As shown, a crimp collar is used. Accordingly, a portion of the impact force applied by the piston 300 will be absorbed by the resilient member 336. Preferably, the resilient member 336 flexes during operation to withstand the force imparted by the piston 300. This allows the ram 302 to last longer, withstanding the repeated impact forces of the piston 300. In some embodiments, and by way of example only, the resilient member 336 could be a nylon reinforced rubber hose, such as a fire hose.

The post receiving member 340 is dimensioned to receive the post and positions the post relative to the piston impact portion 338. The resilient member 336 may be coupled to the post receiving member 340 with fasteners, such as bolts, screws, rivets, adhesive, or other suitable connections, which suspends the piston impact portion 338 above the post receiving member 340. As shown, the ram 302 is slidably received within the driver body 242. In the example shown, a first stop 344 and a second stop 346 limit movement of the ram 302 by limiting movement of the post receiving member 340. In the embodiment shown, the first and second stops 344, 346 are snap rings, but other suitable stops could be used. Preferably, the post receiving member 340 is made of metal, including but not limited to carbon steel, stainless steel and aluminum.

Figure 14:
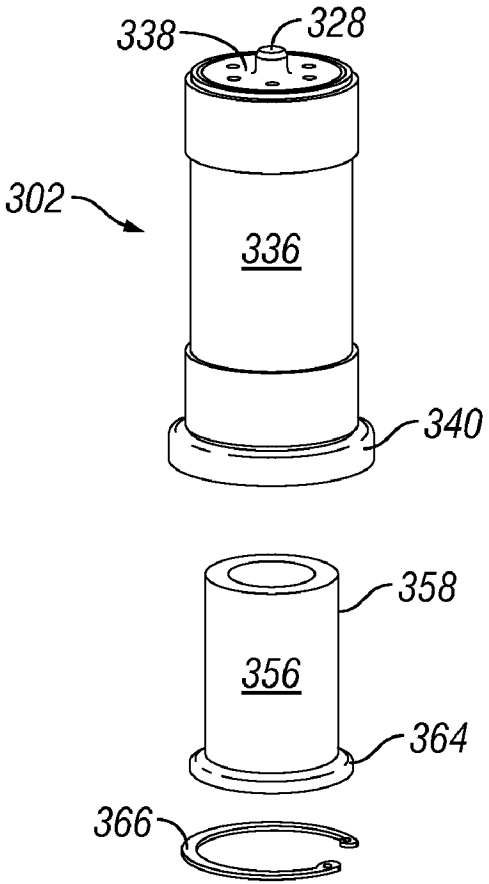
FIG. 14 is an exploded view of the ram shown in FIG. 13 to show the optional drive collar.
Figure 13:
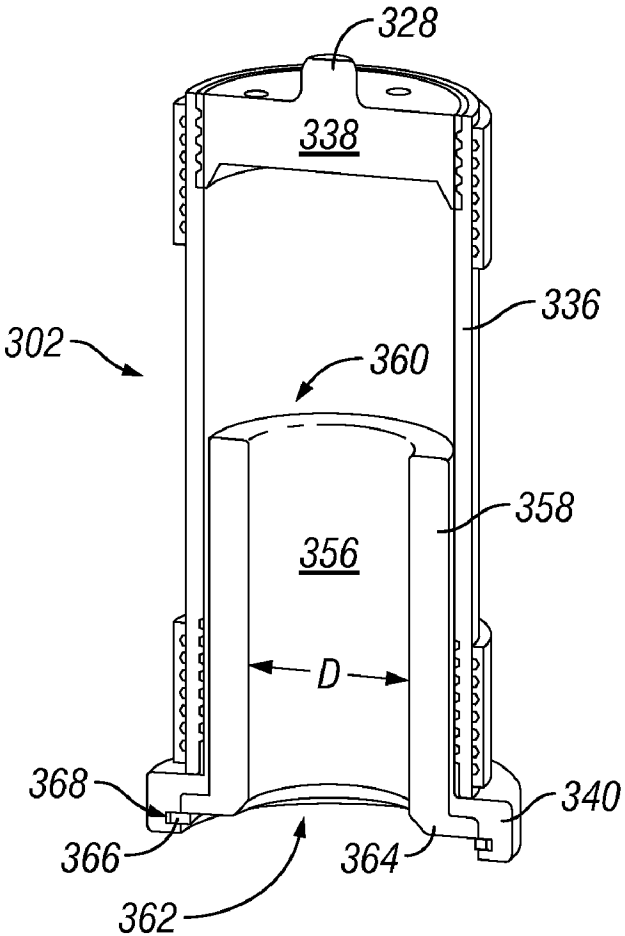
FIG. 13 is a side cross-sectional view of the ram according to another embodiment.
Figure 15:
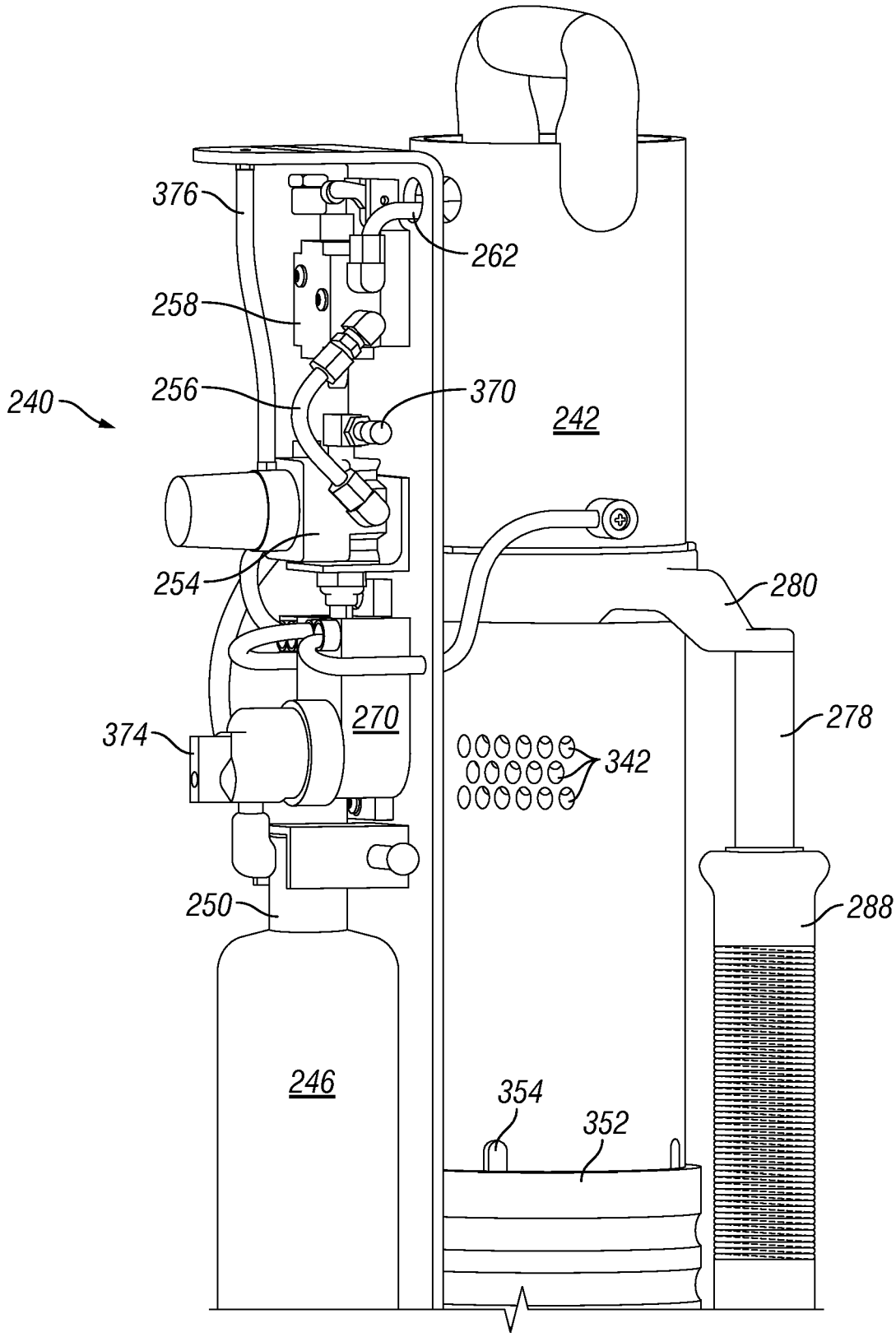
FIG. 15 is a detailed perspective view of the post driver shown in FIG. 1.

FIGS. 13 and 14 show an example embodiment of the ram 302 with an optional drive collar 356. The drive collar 356 allows smaller diameter posts (or other items to be driven) to be received within the post receiving member 340. As shown, the drive collar 356 includes a wall 358 with an upper end 360 within the ram 302 and a lower end 362 through which a post (or other item) is received. As shown, the lower end 362 of the drive collar 356 terminates with a flange 364. In this embodiment, a retainer mechanism 366, such as snap ring, is received by a groove 368 in the post receiving member 340 to hold the drive collar 356 in place. The wall 358 defines an opening with diameter "D" through which a post (or other item) can be received. The drive collar 356 may come in a variety of sizes to accommodate a variety of post sizes. Typically, the drive collar 356 is formed from nylon; however, it should be appreciated by one skilled in the art that other materials would be suitable.

Referring again to FIG. 3, a biasing member 348, such as a spring, is configured to resist downward movement of the piston 300 toward the ram 302. With the system at rest (FIG. 1), the piston 300 is supported by the biasing member 348. The biasing member 348 rests on a ridge 350 extending inward from a priming ring 352 through slots 354. As discussed below, manual movement of the priming ring 352 moves the piston 300, allowing the apparatus 240 to be primed. When combustion in the combustion chamber 266 propels the piston 300 toward the ram 302, the piston 300 will contact the ram 302 and then be propelled in an opposite direction by the biasing member 348.

Figure 17:
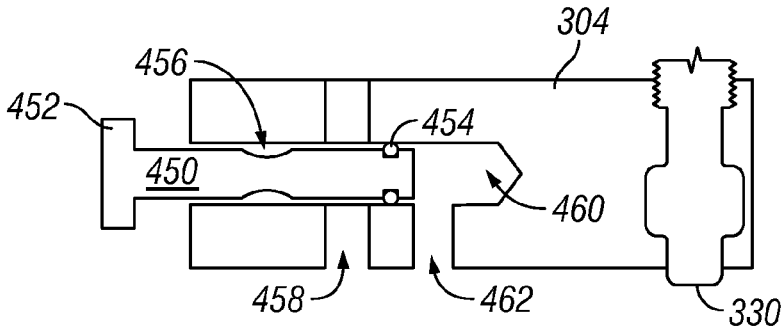
FIG. 17 is a side cross-sectional view of a priming valve according to an alternative embodiment.

FIG. 17 shows an alternative embodiment for priming the apparatus 240. In this example, the priming valve 450 is laterally mounted in the wall 304. As shown, the priming valve 450 includes a proximate end with a handle portion 452, a distal end with a sealed portion 454 and a reduced portion 456 between the ends. In this embodiment, an exhaust vent 458 is defined in the wall 304 for exhaust gases within the combustion chamber 266 to vent to the atmosphere when the priming valve 450 is open. To open the priming valve 450, in the embodiment shown, the user pushes the handle portion 452, which shifts (to the right in this example) the priming valve 450 so that sealed end is disposed in a cavity 460. This movement aligns the reduced portion 456 of the priming valve 450 with the exhaust vent 458. When a combustion occurs in the combustion chamber, 266, the pressure from exhaust gases will flow through a passageway 462 to shift (to the left in this example) the priming valve 450 back to the closed position.

The biasing member 348 is adapted to propel the piston 300 upward through the combustion chamber 266 to contact the wall 304, which causes the pin 310 to move the lever 312, thereby momentarily opening the fuel injection valve 258. The upper portion of the valve 326 contacts the injector 330, thereby closing the valve 326. The piston 300 then falls by gravity to rest on the biasing member 348, which draws air into the combustion chamber 266 through the air intake ports 306.

The embodiment shown in FIG. 16 also includes a plurality of magnets 378 circumferentially arranged around the driver body 242. The magnets 378 substantially fix the position of an internal piston 300 when moving the apparatus 240 from post-to-post to be driven. Without the magnets 378, movement of the piston 300 tends to vent fuel within an internal combustion chamber 266, which may require the apparatus 240 to be re-primed. Since the magnets 378 reduce movement of the piston 300 while moving the apparatus 240, this reduces the number of times that the apparatus 240 needs to be primed. As shown, a ring 380 holds the magnets 378 in place. Typically, the magnets 378 are counter-sunk into the driver body 242. Embodiments are also contemplated in which a heavy spring could be used to reduce movement of the piston 300 when moving the apparatus 240 from post-to-post.

The following describes an example cycle of the apparatus 240. If the combustion chamber 266 does not contain an air/fuel mixture or if the fuel has dissipated from the combustion chamber 266, the apparatus 240 may need to be primed. To prime the apparatus 240, the priming valve 298 is opened by pushing the priming valve actuator 296 as best seen in the examples shown FIGS. 4 and 5. This vents the combustion chamber 266 to the atmosphere and allows upward movement of the piston 300. By moving the priming ring 352 upward (FIG. 6), the piston 300 moves upward via movement of the biasing member 348 to actuate the pin 310, which rotates the lever 312 to depress the valve stem 264 of the fuel injection valve 258, thereby dispensing fuel into the calibrated fuel reservoir 260. This also closes the priming valve 298 due to contact with the piston 300. Moving the priming ring 352 downward to the initial position lowers the piston 300 via gravity, which disengages the piston from the pin 310, thereby releasing the lever 312 from the valve stem 264. This causes the fuel in the calibrated fuel reservoir 260 to be dispensed into the combustion chamber 266 via the injector 330. The downward movement of the piston 300 also draws air within the combustion chamber 266 through the air intake ports 306, thereby providing an air/fuel mixture within the combustion chamber 266. The piston 300 may be cycled in this manner one or more times to provide a well mixed quantity of air/fuel within the combustion chamber 266. Embodiments are contemplated in which the priming valve 298 may be a self-closing vent.

The lower end 244 of the driver body 242 is placed over a post (or other object) to be driven. The top end of the post will be received through the post receiving member 340 and will be adjacent to the lower end of the piston impact portion 338. Due to the weight of the apparatus 240, the ram 302 may move upward until the shoulder of the post receiving member 340 contacts the first stop 344.

With an air/fuel mixture in the combustion chamber 266, the user may actuate the actuator 268 (by pushing in this example), which communicates to the ignition module 270 to continuously generate sparks within the combustion chamber 266. The sparks ignite the air/fuel mixture within the combustion chamber 266. This controlled explosion propels the piston 300 downward (since the valve 326 is in the closed position), overcoming the urging of the biasing member 348, to strike the piston impact portion 338 of the ram 302, as shown in FIG. 7. It has been found that a high rate of sparking, such as 20-24 sparks per second, increases reliability of the apparatus 240.

Figure 8:
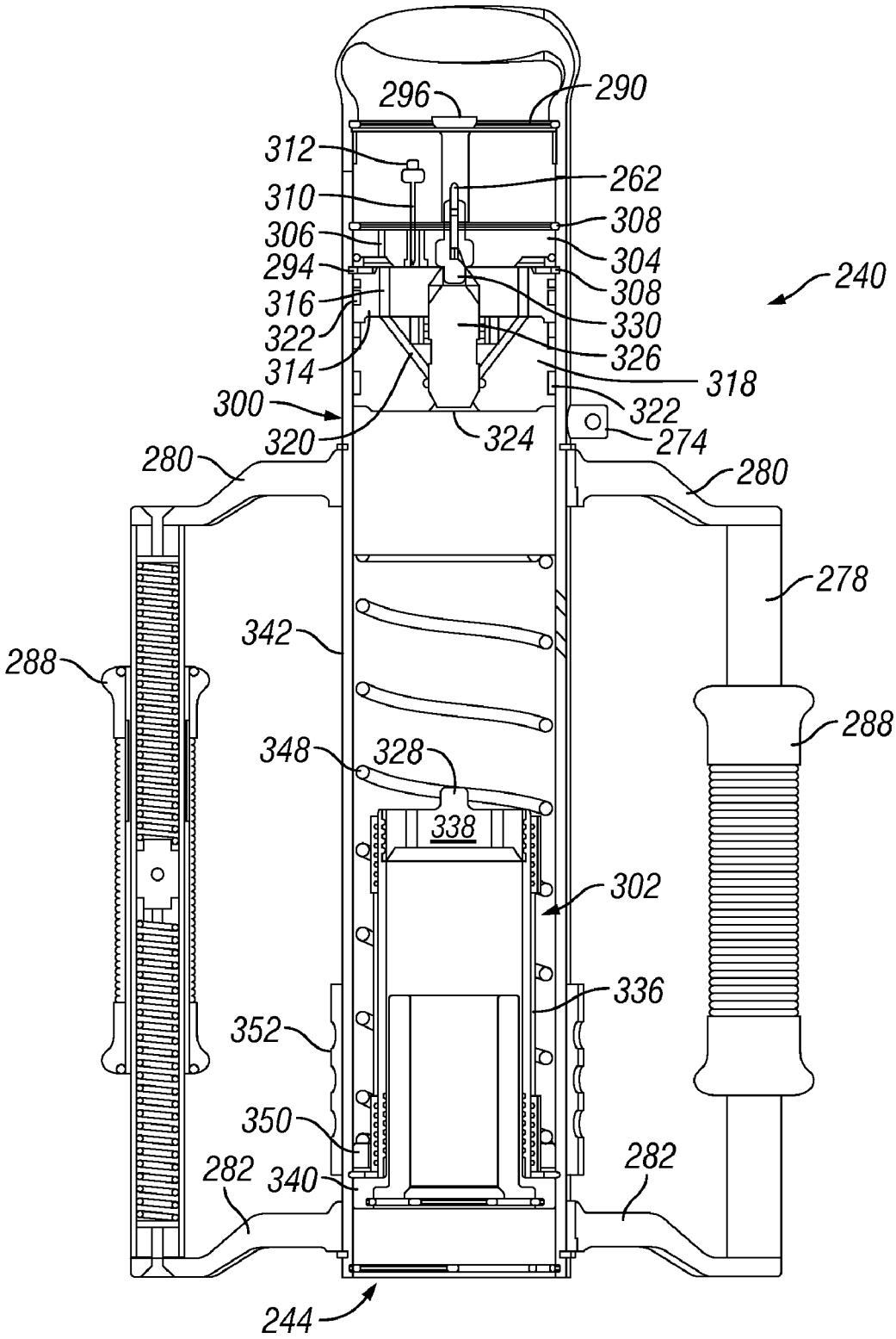
FIG. 8 is a side cross-sectional view of the post driver shown in FIG. 1 with the piston impacting the cylinder head.
Figure 9:
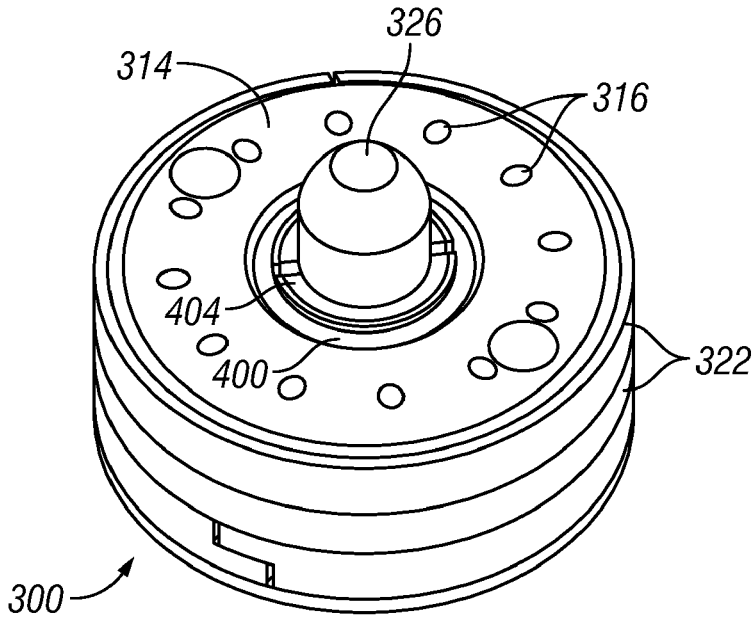
FIG. 9 is a perspective view of the piston shown in FIG. 3 with the upper member removed.
Figure 10:
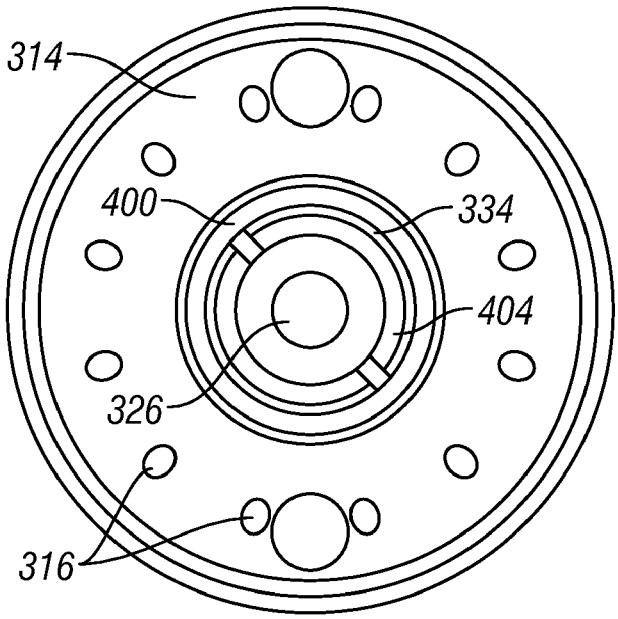
FIG. 10 is a top view of the piston shown in FIG. 3 with the upper member removed.

When the piston 300 contacts the piston impact portion 338 of the ram 302, the lower end of the valve 326 contacts the tip 328 of the piston impact portion 338, which moves the valve 326 to an open position. When the pressure within the combustion chamber decreases 266, due to exiting of exhaust gases through the exhaust ports 342 and 343, the biasing member 348 propels the piston 300 upward to contact the wall 304. As the piston 300 is propelled upward, exhaust gases flow through the piston 300, since the valve 326 is in the open position. When the piston 300 contacts the wall 304, the piston 300 actuates the pin 310, thereby dispensing fuel into the calibrated fuel reservoir 260 (FIG. 8). In addition, the valve 326 moves to the closed position due to the upper end of the valve 326 contacting the injector 330. Since the exhaust gases flowed through the piston 300 during the upward movement, the exhaust gases are trapped below the piston 300 to exit through the exhaust ports 342 and 343. Upon contacting the wall 304, the piston 300 moves downward via gravity. This downward movement draws air into the combustion chamber 266 through the air intake ports 306 for an air/fuel mixture. If the user continues to push the actuator 268, the spark plugs 274 will continue to fire, but ignition will not occur because the piston 300 covers the spark plugs 274 until moving sufficiently downward to expose the combustion chamber 266 to the spark plugs 274. In this example, the position of the spark plugs 274 in the combustion chamber 266 can set the timing of the ignition. It should be appreciated, by one skilled in the art, a number of mechanisms could be used to control the timing of combustion, such as a timing circuit, Hall-effect sensor, optical sensor, etc. Upon ignition, the piston 300 cycles through the same sequence.

Although the present disclosure has been described with reference to particular means, materials, and embodiments from the foregoing description, one skilled in the art can easily ascertain the essential characteristics of the invention and various changes and modifications may be made to adapt the various uses and characteristics without departing from the spirit and scope of the invention.

What is claimed:

1. A combustion powered driver comprising:

a driver body defining a combustion chamber;

a fuel injection valve configured to selectively control a flow of fuel into the combustion chamber;

an ignition module configured to ignite fuel within the combustion chamber;

a ram movable within the driver body, wherein the ram includes a metallic piston impact portion spaced apart from a post receiving portion that defines a cavity dimensioned to receive a post;

a piston movable within the driver body, wherein the piston is configured to impact the ram responsive to combustion within the combustion chamber;

a biasing member configured to urge the piston apart from the ram;

wherein the piston overcomes the urging of the biasing member to impact the piston impact portion of the ram responsive to combustion within the combustion chamber; and wherein the piston impact portion is suspended on a resilient portion extending between the piston impact portion and the post receiving portion, wherein the resilient portion absorbs a portion of an impact force from the piston impacting the piston impact portion.

2. The driver of claim 1, wherein the resilient portion is configured to flex outwardly when the piston impacts the ram.

3. The driver of claim 1, wherein the resilient portion defines a passageway dimensioned to receive at least a portion of a post.

4. The driver of claim 3, wherein the resilient portion is approximately a hollow cylinder in shape.

5. The driver of claim 3, wherein the resilient portion is elongated.

6. The driver of claim 1, wherein the resilient portion is formed at least in part from reinforced nylon.

7. The driver of claim 1, wherein the resilient portion is formed at least in part from a portion of a hose.

8. The driver of claim 1, wherein the post receiving portion is formed from metal.

9. The driver of claim 8, wherein the piston impact portion and the post receiving portion are formed from at least one of steel and cast aluminum.

10. The driver of claim 1, wherein the post receiving portion supports the piston impact portion.

11. The driver of claim 1, wherein the piston impact portion defines at least one exhaust port adapted to allow flow of exhaust gas from combustion disposed between the ram and piston.

12. The driver of claim 11, wherein the driver body defines a plurality of exhaust ports adapted to allow flow of exhaust gas from combustion in the combustion chamber therethrough.

13. The driver of claim 1, wherein the piston defines a passageway therethrough, further comprising a piston valve disposed at least partially within the passageway in the piston and configured to selectively open and close the passageway.

14. The driver of claim 13, wherein the piston valve moves to an open position due to a lower portion of the piston valve contacting a tip extending from the piston impact portion when the piston impacts the piston impact portion of the ram responsive to combustion in the combustion chamber.

15. The driver of claim 14, wherein the piston valve moves to a closed position due to an upper portion of the piston valve contacting a projection extending into the combustion chamber when the biasing member urges the piston away from the ram.

16. The driver of claim 15, further comprising a braking member frictionally engaging an exterior surface of the piston valve.

17. The driver of claim 15, wherein the resilient portion includes a longitudinal opening, wherein the piston impact portion is at least partially disposed within the opening.

18. The driver of claim 16, wherein the post receiving portion is at least partially disposed within the opening.

19. A combustion powered driver comprising:

a driver body defining a combustion chamber;

a fuel injection valve configured to selectively control a flow of fuel into the combustion chamber;

an ignition module configured to ignite fuel within the combustion chamber;

a ram movable within the driver body;

a piston movable within the driver body, wherein the piston defines a passageway therethrough;

a piston valve disposed at least partially within the piston and configured to selectively open and close the passageway;

a biasing member configured to urge the piston apart from the ram;

wherein the piston overcomes the urging of the biasing member to impact the ram responsive to combustion within the combustion chamber;

wherein the piston is configured to reciprocate between a downward stroke in which the piston impacts the ram responsive to combustion in the combustion chamber and a return stroke in which the piston moves away from the ram due to the urging of the biasing member;

wherein a ram projection extending from the ram moves the piston valve to an open position when the piston impacts the ram so the piston valve is in an open position in the return stroke; and wherein a protrusion extending into the combustion chamber moves the piston valve to a closed position when the piston moves away from the ram so the piston valve is in a closed position in the downward stroke.

20. The apparatus of claim 19, wherein the protrusion is an injector dispensing fuel within the combustion chamber.

21. The apparatus of claim 19, further comprising an injection projection extending into the combustion chamber and movable between a first position and a second position responsive to movement of the piston, wherein the injection projection actuates the fuel injection valve when moving from the first position to the second position.

22. The apparatus of claim 21, wherein the injection projection extends from an upper wall of the combustion chamber and the injection projection moves from the first position to the second position when the piston contacts the upper wall of the combustion chamber.

23. The apparatus of claim 22, wherein the protrusion extends from the upper wall of the combustion chamber.

24. The apparatus of claim 19, wherein the piston includes a first member coupled to a second member, wherein the first member defines a plurality of passageways and the second member defines a plurality of passageways, wherein at least a portion of the passageways in the first member are aligned with a portion of the passageways in the second member.

25. The apparatus of claim 24, wherein the piston valve is movable between a closed position blocking flow through the passageways in the first member and the second member and an open position allowing flow through the passageways in the first member and the second member.

26. The apparatus of claim 19, further comprising a braking member frictionally engaging an exterior surface of the piston valve.

27. The apparatus of claim 26, wherein the braking member is substantially cylindrical in shape.

28. The apparatus of claim 27, further comprising at least one biasing member urging the braking member towards the piston.

29. The apparatus of claim 28, wherein the biasing member is at least one of an O-ring and a spring.

30. The apparatus of claim 28, wherein the piston valve includes a groove dimensioned to receive the braking member.

31. The apparatus of claim 19, wherein the piston valve is substantially cylindrical in shape.

32. The apparatus of claim 31, wherein an upper end of the piston valve is tapered.

33. The apparatus of claim 32, wherein a lower end of the piston valve is tapered.

34. The apparatus of claim 19, further comprising a one-way valve configured to permit flow of air through at least one air intake port defined in an upper wall into the combustion chamber, but blocks flow of fluid from the combustion chamber.

35. The apparatus of claim 34, wherein the one-way valve is a Reed valve.

36. The apparatus of claim 35, wherein the fuel injection valve is disposed within the upper wall of the combustion chamber.

37. The apparatus of claim 19, further comprising a first seal surrounding the piston on an end proximate the combustion chamber and a second seal surrounding the piston spaced apart from the first seal, wherein the first seal is fowled at least in part from carbon fiber PTFE to shield the second seal from a portion of heat radiating from the combustion chamber.

38. The apparatus of claim 37, wherein the second seal is formed at least in part from PTFE filled bronze.

39. A free piston internal combustion engine comprising:

a cylinder having a first end with a first projection and a second end with a second projection;

a combustion chamber disposed within the cylinder;

an ignition module configured to ignite fuel within the combustion chamber;

a piston movable within the cylinder between the first end and the second end, wherein the piston moves toward the second end responsive to combustion in the combustion chamber, wherein the piston defines a passageway therethrough;

a biasing member configured to urge the piston toward the first end of the cylinder;

a piston valve movable between an open position and a closed position, wherein the piston valve prevents fluid flow through the passageway in the closed position, but allows fluid flow through the passageway in the open position, wherein at least a portion of the piston valve is disposed within the piston;

wherein the piston is configured to reciprocate between a downward stroke in which the piston impacts the second end of the cylinder responsive to combustion in the combustion chamber and a return stroke in which the piston impacts the first end of the cylinder due to the urging of the biasing member;

wherein the first projection is received in registry with the passageway to move the piston valve to a closed position when the piston impacts the first end of the cylinder so the piston valve is in a closed position in the downward stroke; and wherein the second projection is received in registry with the passageway to move the piston valve to an open position when the piston impacts the second end of the cylinder so the piston valve is in an open position in the return stroke.

40. The free piston internal combustion engine of claim 39, wherein the piston valve has a first end and a second end, wherein the first projection contacts the first end of the piston valve when in registry with the passageway to move the piston valve to the closed position.

41. The free piston internal combustion engine of claim 40, wherein the second projection contacts the second end of the piston valve when in registry with the passageway to move the piston valve to the open position.

* * * * *